US009613563B2

(12) United States Patent
Seong et al.

(10) Patent No.: US 9,613,563 B2
(45) Date of Patent: Apr. 4, 2017

(54) DISPLAY DEVICE AND METHOD THEREOF

(71) Applicant: SAMSUNG ELECTRONICS CO., LTD., Suwon-si (KR)

(72) Inventors: Hwa-seok Seong, Suwon-si (KR); Sung-Soo Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 64 days.

(21) Appl. No.: 14/511,500

(22) Filed: Oct. 10, 2014

(65) Prior Publication Data

US 2015/0103108 A1 Apr. 16, 2015

(30) Foreign Application Priority Data

Oct. 10, 2013 (KR) ..... 10-2013-0120588

(51) Int. Cl.
*G09G 3/3208* (2016.01)
*G09G 3/22* (2006.01)

(52) U.S. Cl.
CPC ..... *G09G 3/3208* (2013.01); *G09G 3/22* (2013.01); *G09G 2320/0271* (2013.01); *G09G 2320/046* (2013.01); *G09G 2320/0686* (2013.01); *G09G 2360/16* (2013.01)

(58) Field of Classification Search
None
See application file for complete search history.

(56) References Cited

U.S. PATENT DOCUMENTS

2006/0164408 A1* 7/2006 Nishikawa ..... G09G 3/3233 345/207
2009/0002360 A1* 1/2009 Chen ..... G09G 3/3648 345/214
2010/0090999 A1* 4/2010 Komiya ..... G09G 3/3233 345/207
2011/0128302 A1* 6/2011 Cho ..... G09G 3/3426 345/690
2011/0242147 A1 10/2011 Muto et al.
2012/0044270 A1* 2/2012 Arkhipov ..... G09G 3/32 345/690
2012/0169789 A1 7/2012 Origuchi et al.
2012/0256971 A1 10/2012 Shin et al.
2014/0320475 A1* 10/2014 Shin ..... G09G 3/3275 345/212

FOREIGN PATENT DOCUMENTS

JP 2011-232718 A 11/2011
JP 2011-257515 A 12/2011
KR 10-2007-0033230 A 3/2007
KR 10-2012-0046770 A 5/2012
KR 10-2012-0114988 A 10/2012

* cited by examiner

*Primary Examiner* — David D Davis
(74) *Attorney, Agent, or Firm* — Sughrue Mion, PLLC

(57) ABSTRACT

A display apparatus includes: a display panel configured to display an image frame; an arithmetic operator configured to divide the image frame into blocks, calculate a pixel gradation value of the pixel blocks, and accumulate the calculated pixel gradation values; and a compensator configured to locally reduce a luminance of a corresponding pixel block, of which a respective accumulated pixel gradation value exceeds a threshold value of among the plurality of pixel blocks, and to compensate for a luminance difference between the corresponding pixel block, for which the luminance has been reduced, and surrounding pixel blocks. Accordingly, it is possible to effectively remove an afterimage.

13 Claims, 8 Drawing Sheets

DISPLAY DEVICE AND METHOD THEREOF

CROSS-REFERENCE TO RELATED APPLICATION

This application claims priority from Korean Patent Application No. 10-2013-0120588, filed in the Korean Intellectual Property Office on Oct. 10, 2013, the disclosure of which is incorporated herein by reference in its entirety.

BACKGROUND

1. Field

Methods and apparatuses consistent with exemplary embodiments relate to a display apparatus and display method thereof, and more particularly, to a display apparatus configured to remove an afterimage of a display screen, and a display method thereof.

2. Description of the Prior Art

Recently, various spontaneous emission display apparatuses with reduced weight and volume, as compared to older cathode ray tube displays, have been developed. Such display apparatuses include plasma display (PD) apparatuses, Light Emitting Device (LED) display apparatuses, Organic Light Emitting Device (OLED) display apparatuses, etc.

Particularly, an OLED display apparatus does not need backlight for providing light from the rear surface of a liquid crystal panel as in a liquid crystal display apparatus, and, thus, the thickness of the OLED display apparatus may be reduced, which is an advantage. The OLED display apparatus uses red, green, and blue OLEDs, which are arranged between a single power voltage VDD generally provided at the power supply end and power voltage VSS of the power ground end, and switching elements such as field-effect transistors (FET) which are connected between OLEDs and the power voltage.

However, fixed pattern portions, such as logos and subtitles, displayed on a screen of a spontaneous display apparatus may have high luminance values. When displayed for a long time, the life span of a spontaneous emission display apparatus deteriorates sharply, and image sticking may occur.

According to the related art, the RGB gradation values of an image are accumulated, compared with a threshold, and the luminance duty of the entirety of the screen is reduced, based on a comparison, to solve the image sticking problem, i.e., an afterimage problem.

However, reducing the luminance value of the entire screen results in deteriorating the quality of the screen.

SUMMARY

Exemplary embodiments may address at least the above problems and/or disadvantages and other disadvantages not described above. The exemplary embodiments are not required to overcome the disadvantages described above, and may not overcome any of the problems described above.

One or more exemplary embodiments provide a display apparatus and display method that locally adjusts only the luminance of an area having a high luminance on a display screen, thereby resolving image sticking problem and preventing deterioration of the quality of the screen.

According to an aspect of an exemplary embodiment, there is provided a display apparatus, including: a display panel configured to display an image frame; an arithmetic operator configured to divide the image frame into a plurality of pixel blocks, and to calculate a pixel gradation value of each of the plurality of pixel blocks and accumulate the calculated pixel gradation value; a storage configured to store the accumulated pixel gradation value; and a compensator configured to locally reduce a luminance of a block of which the accumulated pixel gradation value exceeds a threshold of among the plurality of pixel blocks, and to compensate for a luminance difference between the block of which the luminance has been reduced and surrounding blocks.

The compensator may include a gain calculator configured to calculate a gain value for individually adjusting each luminance of the plurality of pixel blocks based on the accumulated pixel gradation value of the plurality of pixel blocks; a compensation gain calculator configured to filter the gain value and to calculate a compensation gain value; and a pixel adjuster configured to calculate a pixel gain value for each pixel of the plurality of pixel blocks and to reflect the calculated pixel gain value to the gradation value of each pixel and then to provide the gradation value of the pixel to a display panel.

The compensation gain calculator may include a first compensation gain calculator configured to apply an edge conservation smoothing filter to the calculated gain edge value and calculate a first compensation gain value for compensating for a luminance difference between the plurality of pixel blocks; and a second compensation gain calculator configured to apply an Infinite Impulse Response (IIR) filter regarding the first compensation gain value, calculate a second compensation gain value for removing a flicker according to a luminance adjustment of the plurality of blocks, and to provide the second compensation gain value to the pixel adjuster.

The edge conservation smoothing filter may be a diffusion filter or a bilateral filter.

The second compensation gain calculator may use calculation function, to calculate the second compensation gain value:

$$Giir = \frac{(Wa * Ga + Wc * Gc)}{Wa + Wc}$$

wherein Giir may be the second compensation gain value, Ga may be a gain value of a previous frame, Gc may be a gain value of a present frame, Wa may be a weighted value of a gain value of the previous frame, and We may be a weighted value of a gain value of the present frame.

The gain calculator may classify a pixel block of which the accumulated pixel gradation value is less than a first threshold as a luminance maintaining area, classify a pixel block of which the accumulated pixel gradation value is the first threshold or more and less than a second threshold as a middle area, and classify a pixel block of which the accumulated pixel gradation value is the second threshold ore more as an afterimage improving area, and set a gain value for the luminance maintaining area to a first value, a gain value for the afterimage improving area to a second value smaller than the first value, and calculate a gain value for the middle area according to a linear function or a non-linear function between the first value and the second value.

The linear function may be $$Y = \left(\frac{b - a}{THb - THa}\right) * (X - THa) + a$$

wherein X is the accumulated pixel gradation value, Y is a gain value, THa is the first threshold, THb is the second threshold, a is the first value, and b is the second value.

The pixel adjuster may apply a weighted value according to a distance between surrounding blocks regarding each pixel in the plurality of pixel blocks to the compensation gain value, calculate a gain value per pixel, reflect calculated gain value per pixel to each pixel, and provide corrected pixel gradation value to the display panel.

According to an aspect of an exemplary embodiment, there is provided a display method of a display apparatus, the method including: dividing an image frame displayed on a display panel into a plurality of pixel blocks; calculating a pixel gradation value of each of the plurality of pixel blocks; accumulating the calculated pixel gradation value and storing the accumulated pixel gradation value; and locally reducing a luminance for a block of which the accumulated pixel gradation value exceeds a threshold of among the plurality of pixel blocks, and compensating for a luminance difference between the block of which the luminance has been reduced and surrounding blocks.

The compensating may further include calculating a gain value for individually adjusting each luminance of the plurality of pixel blocks based on the accumulated pixel gradation value of the plurality of pixel blocks; filtering the gain value and calculating the compensation gain value; and calculating a pixel gain value for each pixel of the plurality of pixel blocks, based on the compensation gain value, reflecting the calculated pixel gain value to a gradation value of each pixel, and providing the pixel gradation value where the pixel gain value has been reflected to the display panel.

The calculating the compensation gain value may include applying a smoothing to the calculated gain edge value and calculating a first compensation gain value for compensating for a luminance difference between the plurality of pixel blocks; and applying an IIR filter regarding the first compensation gain value, and calculating a second compensation gain value for removing a flicker according to a luminance adjustment of the plurality of blocks.

The edge conservation smoothing filter may be a diffusion filter or bilateral filter.

The calculating a second compensation gain value may use calculation function to calculate the second compensation gain value:

$$Giir = \frac{(Wa * Ga + Wc * Gc)}{Wa + Wc}$$

wherein Giir is the second compensation gain value, Ga is a gain value of a previous frame, Gc is a gain value of a present frame, Wa is a weighted value of a gain value of the previous frame, and We is a weighted value of a gain value of the present frame.

The gain calculator may classify a pixel block of which the accumulated pixel gradation value is less than a first threshold as a luminance maintaining area, classify a pixel block of which the accumulated pixel gradation value is the first threshold or more and less than a second threshold as a middle area, and classify a pixel block of which the accumulated pixel gradation value is the second threshold ore more as an afterimage improving area, and set a gain value for the luminance maintaining area to a first value, a gain value for the afterimage improving area to a second value smaller than the first value, and calculate a gain value for the middle area according to a linear function or a non-linear function between the first value and the second value.

The linear function may be $$Y = \left(\frac{b - a}{THb - THa}\right) * (X - THa) + a$$

wherein X is the accumulated pixel gradation value, Y is a gain value, THa is the first threshold, THb is the second threshold, a is the first value, and b is the second value.

The pixel adjusting may involve applying a weighted value according to a distance between surrounding blocks regarding each pixel in the plurality of pixel blocks to the compensation gain value, calculating a gain value per pixel, reflecting calculated gain value per pixel to each pixel, and providing corrected pixel gradation value to the display panel.

According to the aforementioned various exemplary embodiments, it is possible to extend the life span of a display apparatus by adjusting the luminance of the screen images locally. In addition, it is possible to improve the efficiency of the apparatus by preventing image sticking.

BRIEF DESCRIPTION OF THE DRAWINGS

The above and/or other aspects will become more apparent by describing certain exemplary embodiments with reference to the accompanying drawings, in which.

DETAILED DESCRIPTION

Figure 1:
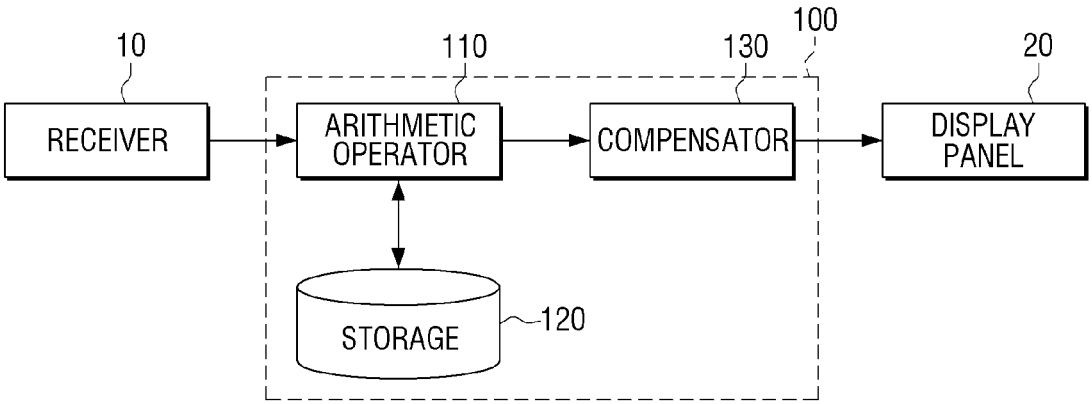
FIG. 1 is a block diagram of a display apparatus according to an exemplary embodiment.

Certain exemplary embodiments are described in greater detail below with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters. Also, well-known functions or constructions are not described in detail since they would obscure the application with unnecessary detail.

FIG. 1 is a block diagram of a display apparatus according to an exemplary embodiment.

According to FIG. 1, a display apparatus according to an exemplary embodiment may include a receiver 10, a display panel 20, and an adjuster 100. The adjuster 100 includes an arithmetic operator 110, storage 120, and compensator 130.

The receiver 10 receives image data from a source such as a TV broadcast, DVD, blu-ray, etc., decodes the received image data, and provides the decoded image data to the display panel 20. The display panel 20 displays an image frame corresponding to the received image data.

The receiver 10 may transmit image data of each image frame of contents to the arithmetic operator 110. The arithmetic operator 110 may divide the image frame displayed on the display panel 20 into a plurality of pixel blocks based on the image data. The arithmetic operator 110 calculates a pixel gradation value of each pixel block.

More specifically, the arithmetic operator 110 receives the image data received in the receiver 10. The image data provided to the arithmetic operator 110 has an RGB gradation value per pixel. The RGB gradation value per pixel may be embodied as data of 8 bit, 10 bit, etc. The size of a frame is different depending on the screen resolution.

The arithmetic operator 110 divides the image frame displayed on the display panel 20 into a plurality of pixel blocks based on the provided image data. Then, the arithmetic operator 110 calculates a pixel gradation value, that is, an RGB gradation value regarding each of the plurality of pixel blocks, and accumulates the calculated gradation values per pixel block. The calculated gradation values per each of the pixel blocks may be accumulated for a period of time or for a number of frames. The RGB gradation value per pixel includes 8 bit, 10 bit, etc.

Below is presented a detailed explanation of a process of calculating an image frame in a plurality of pixel blocks. First of all, the arithmetic operator 110 may use a line counter and pixel counter to divide an image frame into a plurality of pixel blocks. One pixel block may be displayed by a spontaneous emission element group that includes a plurality of spontaneous emission elements.

For example, in the case of a full HD image, a screen resolution is 1920*1080. Assuming one pixel block is 48*36, 40 pixel blocks are arranged horizontally and 30 pixel blocks are arranged vertically. A pixel counter may have values from 0 to 47, and a line counter may have values 0 to 35, per pixel block. Per frame, 1920*1080 pixel RGB gradations are input. Whenever a pixel RGB gradation value is input, a pixel counter increases by one. When 49th pixel is input after 48th pixel RGB gradation value is input into the arithmetic operator 110, the pixel counter returns to 0.

The pixel blocks of the 1st line are defined and, in the case of the next line, that is resolution (0, 1), the line counter increases by one.

In this method, it is possible to calculate a pixel gradation value, that is, RGB gradation value per block of the frame forming one screen.

The storage 120 may accumulatively store the RGB gradation value per pixel block calculated by the arithmetic operator 110. The storage 120 may include a DDR, RAM, ROM, flash memory, CD, DVD, etc. The storage 120 may store threshold information that becomes the criteria for luminance adjustment.

The compensator 130 performs local compensation regarding a plurality of pixel blocks forming an image frame.

The compensator 130 checks the pixel gradation value stored in the storage 120, and searches for the block where the accumulated pixel gradation value exceeds the threshold of among the plurality of pixel blocks. Then, the compensator 130 adjusts the luminance regarding the searched block. Consequently, since the luminance regarding the local pixel block may be reduced, the problem of afterimage of that portion may be resolved. The compensator 130 may compensate for the luminance difference between the block having the reduced luminance and the surrounding blocks and may also remove the flicker due to a luminance change within the same block, the same pixel, or the same group of pixels over a time period.

More specifically, the compensator 130 may use the RGB gradation value accumulated in the arithmetic operator 110 to calculate a gain value per pixel block, and send the RGB gradation value per pixel where a gain value per pixel is reflected in the display panel 20. The gain value per pixel may be set as a value greater than 0 and smaller than or equal to 1. The compensator 130 multiplies the RGB gradation value sent from the receiver 10 to the arithmetic operator 110 with the compensated gain value and sends the result of multiplication to the display panel 20.

The display panel 20 illuminates spontaneous emission elements (e.g. OLEDs, LEDs) according to each pixel RGB gradation value and forms the frame. More specifically, the display panel 20 receives RGB gradation values of a plurality of pixel blocks, applies controllable voltages, and illuminates the spontaneous emission elements per pixel, per a group of pixels, or per a pixel block. A viewer may then view a screen for which the luminance has been improved locally. By this, the display apparatus may remove the image sticking. The flicker due to local luminance change may also be improved.

Hereinbelow is provided a detailed explanation of the operations of the compensator 130.

The arithmetic operator 110 was described to calculate a pixel gradation value per pixel block, but there is no limitation thereto. For example, the arithmetic operator 110 may use the RGB gradation value accumulated per pixel block to calculate the average of RGB gradation values per block and store the average in the storage 120. The arithmetic operator 110 may store the number of pixels having an RGB gradation value exceeding the threshold of the pixels in each pixel block or/and its gradation value in the storage 120.

As aforementioned, the arithmetic operator 110 may calculate a gradation feature value of each pixel block by various methods. The compensator 130 may use the gradation feature value calculated by each method and the threshold to determine the object of luminance adjustment, and may adjust the luminance of the object block.

Figure 2:
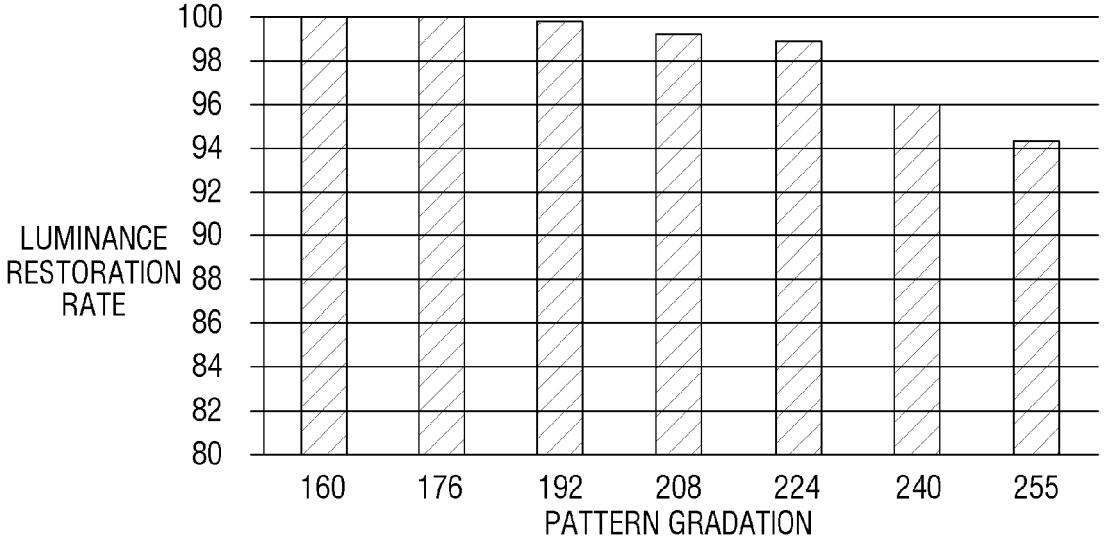
FIG. 2 is a view for explaining advantages of adjusting only the luminance of a pixel having a high gradation value.

FIG. 2 is a view for explaining advantages of adjusting only the luminance of the pixel having a high gradation value. FIG. 2 illustrates a relationship between gradation and luminance restoration rate according to time.

More specifically, FIG. 2 is a histogram comparing the luminance restoration rate per gradation value in the case where the display screen is driven for 5 hours. The X axis is the pattern gradation value and Y axis is the luminance restoration rate.

Herein, when the gradation value is a relatively medium gradation of 160, 176, 192, etc., it can be seen that the luminance restoration rate is 100% or close to 100%. However, when the gradation value is a relatively high gradation of 224, 240, and 255, it can be seen that the luminance restoration rate decrease to as low as mid 90%. Based on this experimental result, it is possible to obtain an effect where an image sticking of the subject pixel block is removed, thereby extending the life span of the display screen. This can be achieved if the luminance value of the block of high gradation is reduced. That is, it is possible to remove image sticking by adjusting the luminance of a smaller portion of the screen more efficiently than adjusting the luminance duty of the entire screen, thereby preventing deterioration of the quality of screen.

Figure 3:
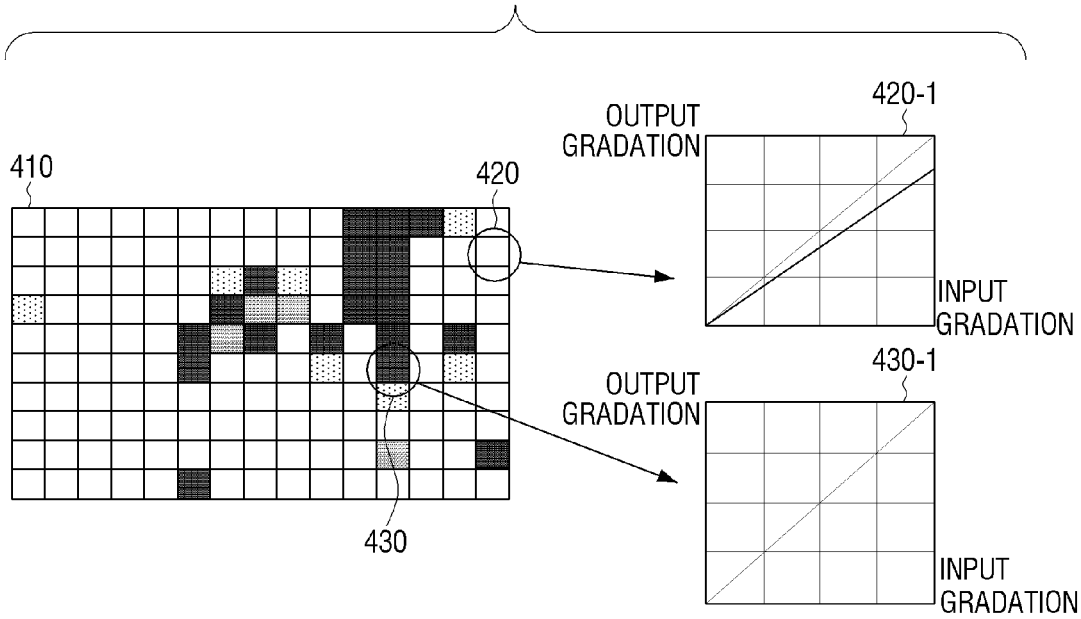
FIG. 3 is a view illustrating a correlation between an input gradation and an output gradation of an image frame output from a display apparatus according to an exemplary embodiment.

FIG. 3 is a view illustrating a correlation of an input gradation and an output gradation of an image frame output from a display apparatus according to an exemplary embodiment.

According to FIG. 3, the view 410 at the left side illustrates a state where a screen displayed on the display panel 20 is divided into a plurality of pixel blocks. The pixel blocks may include pixel blocks 420 having bright luminance values and pixel blocks 430 having dark luminance values.

In the case where a pixel block 420 having a bright luminance value is continuously and/or repeatedly displayed for a certain period of time, the display apparatus reduces the output gradation value as compared to the input gradation value, and prevents an afterimage. On the other hand, in the case of a pixel block 430 having a dark luminance value, image sticking does not occur even without reducing the output gradation, and thus there is no effect on the life span of the display apparatus even when the output gradation is not adjusted. That is, the display apparatus may locally adjust the luminance and perform removing of afterimage without significantly reducing the overall luminance of the entire screen.

Herein, X axis of each graph 420-1, 430-1 according to the luminance value of the pixel block represents the input gradation and Y axis represents the output gradation. The gradient of first graph 420-1 may be smaller than 1 and the gradient of second graph 430-1 may be 1 or close to 1.

With reference to FIG. 3, the output gradation value of the pixel block 420 having a bright luminance value is reduced while the output gradation value of the pixel block 430 having a dark luminance value is not changed or is not changed significantly.

Figure 4:
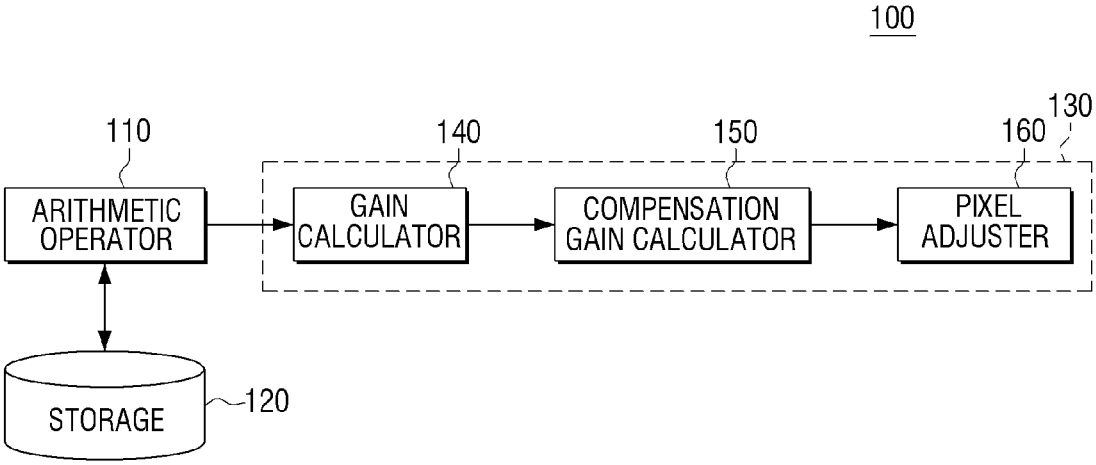
FIG. 4 is a block diagram illustrating an example of a detailed configuration of a portion of a display apparatus of FIG. 1.

FIG. 4 is a block diagram illustrating an example of a detailed configuration of an adjuster 100 used in a display apparatus of FIG. 1.

According to FIG. 4, the adjuster 100 may include an arithmetic operator 110, storage 120, and compensator 130. The adjuster 100 of FIG. 3 may be embodied as a System on Chip (SoC), but is not limited thereto.

The arithmetic operator 110 and storage 120 were explained in detail hereinabove in FIG. 1 and thus repeated explanation is omitted.

The compensator 130 includes a gain calculator 140, compensation gain calculator 150, and pixel adjuster 160.

The gain calculator 140 calculates a gain value for individually adjusting each luminance of the plurality of pixel blocks based on the accumulated pixel gradation values of the plurality of pixel blocks. The gain value calculated through the gain calculator 140 is a gain value at a state where the luminance discontinuity between the surrounding pixel blocks has not been removed. The details of the calculation method are explained with reference to FIG. 5.

The compensation gain calculator 150 filters the gain value, and calculates a compensation gain value. Detailed explanation is made with reference to FIG. 6.

Based on the compensation gain value, the pixel adjuster 160 calculates a gain value for each pixel of the plurality of pixel blocks and reflects it to the pixel and transmits it to the display panel. The functions of the pixel adjuster 160 are explained in detail with reference to FIGS. 7A and 7B.

Figure 5:
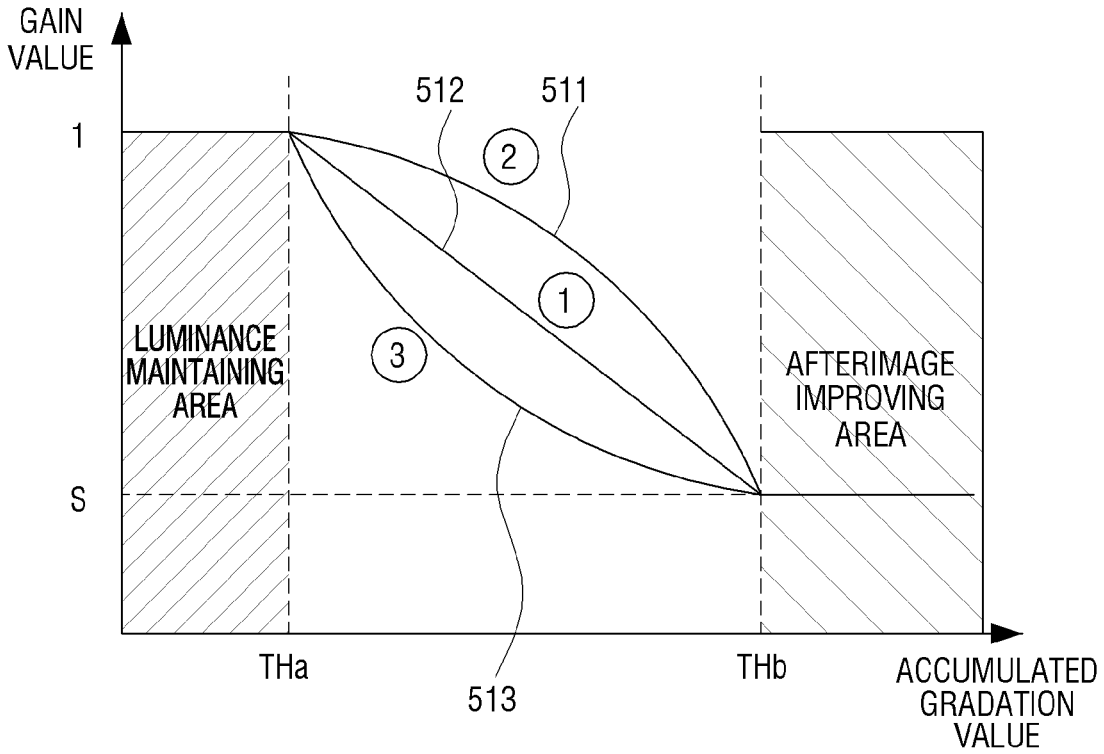
FIG. 5 is a view illustrating a relationship between an accumulated gradation value and a gain value.

FIG. 5 is a view illustrating a relationship between the accumulated gradation value and gain value. The gain calculator 140 uses the function of the graph illustrated in FIG. 5 and calculates a gain value.

More specifically, the gain calculator 140 may classify the pixel block of which the accumulated pixel gradation value is less than the first threshold as luminance maintaining area, i.e., a first area, and classify the pixel block of which the accumulated pixel gradation value is equal to or more than the first threshold and less than the second threshold as a middle area, i.e., a second area, and classify the pixel block of which the accumulated pixel gradation value is equal to or more than the second threshold as an afterimage improving area, i.e., a third area. The gain calculator 140 may set the gain value for the luminance maintaining area as a first value, set the gain value for the afterimage improving area as a second value smaller than the first value, and calculate the gain value for the middle area according to a linear function or a nonlinear function between the first value and second value.

According to FIG. 5, Y axis represents a gain value, and X axis represents an accumulated gradation value per pixel block. FIG. 5 illustrates a state where the first value is set to 1, and the second value is set to S. THa represents the first threshold value, and THb represents the second threshold value.

With respect to Y axis of graph of FIG. 5, when the gain value is 1, it is a case where the input gradation and the output gradation are the same. The gain value of 1 may be predetermined and stored in a register (not illustrated) or other memory. S is a criteria value of an afterimage improving gain, and may be predetermined and stored. The condition 0<gain value <=1 is satisfied. S value may be predetermined as a value equal to 1 or smaller than 1. For example, if S is 0.8, the output gradation value is a result of multiplying 0.8 to the input gradation value.

With respect to X axis, THa is the first threshold value. The first threshold value is a value set to distinguish the luminance maintaining area from the middle area. THb is the second threshold value that distinguishes the middle area from the afterimage improving area. THa and THb may be set arbitrarily, and may also be stored in a register (not illustrated). The luminance maintaining area includes at least one pixel block for which the luminance is not changed. The afterimage improving area includes at least one pixel block for which the luminance is adjusted so that the afterimage can be removed. The middle area includes the remaining pixel blocks that do not belong to the luminance maintaining area and the afterimage improving area.

For example, in the luminance maintaining area, since the gain value is 1, the input gradation value and the output gradation value are identical to each other. There is no change of luminance. When each RGB gradation of the pixel block is reflected on the screen, it corresponds to low or medium gradation overall, and is a block that appears dark on the screen.

The afterimage improving area has a bigger input gradation value than the output gradation value. The pixel block belonging to the afterimage area has a high luminance before luminance adjustment which is reduced according to S value. This way, it is possible to extend the life span of the display screen and prevent the afterimage.

In addition, calculating a gain value of the pixel block belonging to the middle area is performed by connecting the first coordinate (THa, 1) with the second coordinate (THb, S). Since the gain value gradually falls, it is possible to obtain the removal of luminance discontinuity.

The two coordinates may be connected in linear or nonlinear manner.

According to an exemplary embodiment, the gain calculator 140 may calculate the gain value of the middle area using the linear function (refer to ①) that is modeled by mathematical formula 1 as shown below.

$$Y = \left(\frac{b-a}{THb-THa}\right) * (X - THa) + a \quad \text{[Mathematical formula 1]}$$

Herein, X is an accumulated pixel gradation value, Y is a gain value, THa is the first threshold value, THb is the second threshold value, a is the first value, and b is the second value.

According to another exemplary embodiment, the gain calculator 140 may use the nonlinear functions (refer to ② and ③) to calculate the gain value of the middle area. Nonlinear functions include exponential functions, fractional functions, high-degree polynomial functions, and log functions etc.

Regarding the second nonlinear mapping 513, in the case where the luminance of the afterimage improving area is changed according to S value, there is a favorable aspect in terms of luminance discontinuity. That is because the increased value of the gain value between the afterimage improving area and the middle area is smaller than the linear mapping 512 and the first nonlinear mapping 511.

When the gain value is calculated as aforementioned, the compensation gain calculator 150 filters the gain value and calculates the compensation gain value. Smoothing filter, an IIR filter and other types of filters may be used in filtering.

Figure 6:
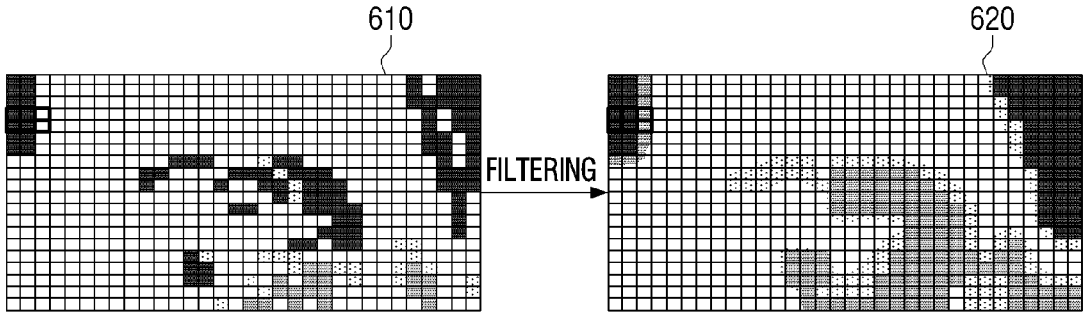
FIG. 6 is a view illustrating changes of a display screen before and after applying a smoothing filter.

FIG. 6 is a view illustrating changes of a display screen before and after applying a smoothing filter. In FIG. 6, the screen prior to filtering is the screen 610 where gain value S has been applied, and the screen after filtering is the screen 620 filtered with an edge conservation smoothing filter.

The edge conservation smoothing filter is used to remove the luminance discontinuity in a method of filtering so as to preserve the edge portion of the object. The compensation gain calculator 150 may include a first compensation gain calculator (not illustrated) that calculates a first compensation gain value based on the gain value by applying the edge conservation smoothing filter.

The first compensation gain calculator may use a diffusion filter or bilateral filter that has an edge conservation smoothing effect. Accordingly, it may remove the luminance discontinuity between the pixel blocks (i.e., spatial discontinuity at the boundaries of the pixel blocks or pixels disposed at the boundaries of the pixel blocks) or between the pixels within the pixel blocks. With reference to FIG. 6, it can be seen that the luminance values of the pixel blocks of the screen 620 after the filtering are more continuously connected than that on the screen 610 prior to filtering.

The compensation gain calculator 150 may further include a second compensation gain calculator (not illustrated) that may apply an IIR filter to the first compensation gain value, to calculate a second compensation value for removing the flicker due to luminance change of a plurality of blocks. The second compensation gain calculator provides the calculated second compensation gain value to the pixel adjuster 160.

The second compensation gain calculator removes the luminance discontinuity among pixels due to time change within the pixel block, i.e., temporal luminance discontinuity. The second compensation gain calculator may use the calculation function as mathematic formula 2 below and calculate the second compensation gain value.

$$Giir = \frac{(Wa * Ga + Wc * Gc)}{Wa + Wc} \quad \text{[Mathematical formula 2]}$$

Herein, Giir is the second compensation gain value, Ga is the gain value of the previous frame, Gc is the gain value of the present frame, Wa is the weighted value of the gain value of the previous frame, and Wc is the weighted value of the gain value of the present frame. If Wa>Wc, the luminance of the pixel block changes slowly, and if Wa<Wc, the luminance of the pixel block changes quickly.

Figure 7A:
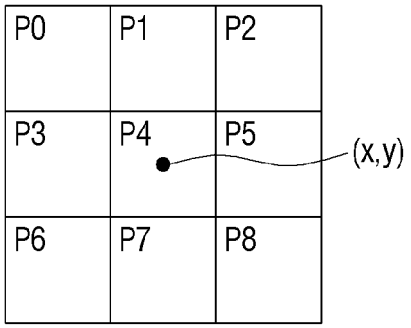
FIGS. 7A and 7B are views illustrating distance weighted values between surrounding blocks to calculate an RGB gradation value per pixel.
Figure 7B:
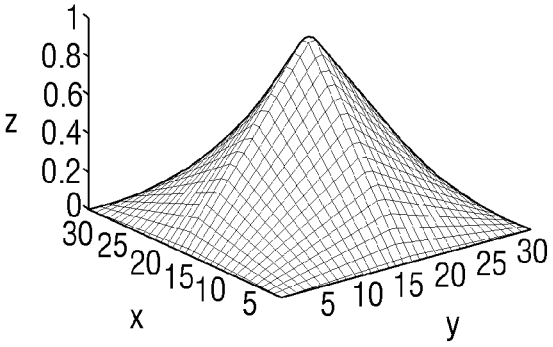

FIGS. 7A and 7B are views illustrating distance weighted values between surrounding blocks to calculate an RGB gradation value per pixel.

According to FIGS. 7A and 7B, when a second compensation gain value is calculated in the second compensation gain calculator, the pixel adjuster 160 calculates each pixel gradation of the pixel block.

The pixel adjuster 160 may perform distance interpolation using the distance weighted value to calculate each pixel gradation. That is, the pixel adjuster 160 determines different weighted values according to the distance between each pixel and surrounding pixels within the pixel block. The pixel adjuster 160 applies a weighted value determined per pixel to the second compensation gain value calculated regarding the corresponding pixel block and corrects the second compensation gain value per pixel. Accordingly, it is possible to calculate a gain value adjusted per pixel.

The pixel adjuster 160 applies the adjusted gain value to change the pixel gradation value, and transmits the image data including the changed pixel gradation value to the display panel 20.

More specifically, if a point of a block P4 of FIG. 7A is (X, Y), a distance interpolation is performed using the distance weighted value regarding the surrounding blocks P0, P1, P2, P3, P5, P6, P7, and P8.

If Pave(X, Y) is the gain value of a pixel(X, Y), Pig is the gain value of the surrounding block i, and Wi(X, Y) is the distance weighted value between the surrounding block i and pixel(X, Y), the gain value Pave per pixel is derived by the mathematical formula below.

$$\text{Pave}(X,Y) = \Sigma Wi(X,Y)\text{Pig} \quad \text{[Mathematical formula 3]}$$

FIG. 7B is a view illustrating the distance weighted value of the surrounding block i according to (X, Y) coordinates. X axis is the X coordinate of the pixel, Y axis is the Y coordinate of the pixel, and Z axis is the weighted value. It is possible to calculate the gain value per pixel using formula 3. The pixel adjuster 160 multiplies this gain value by the RGB gradation value and transmits the new RGB gradation value to the display panel 20.

Figure 8:
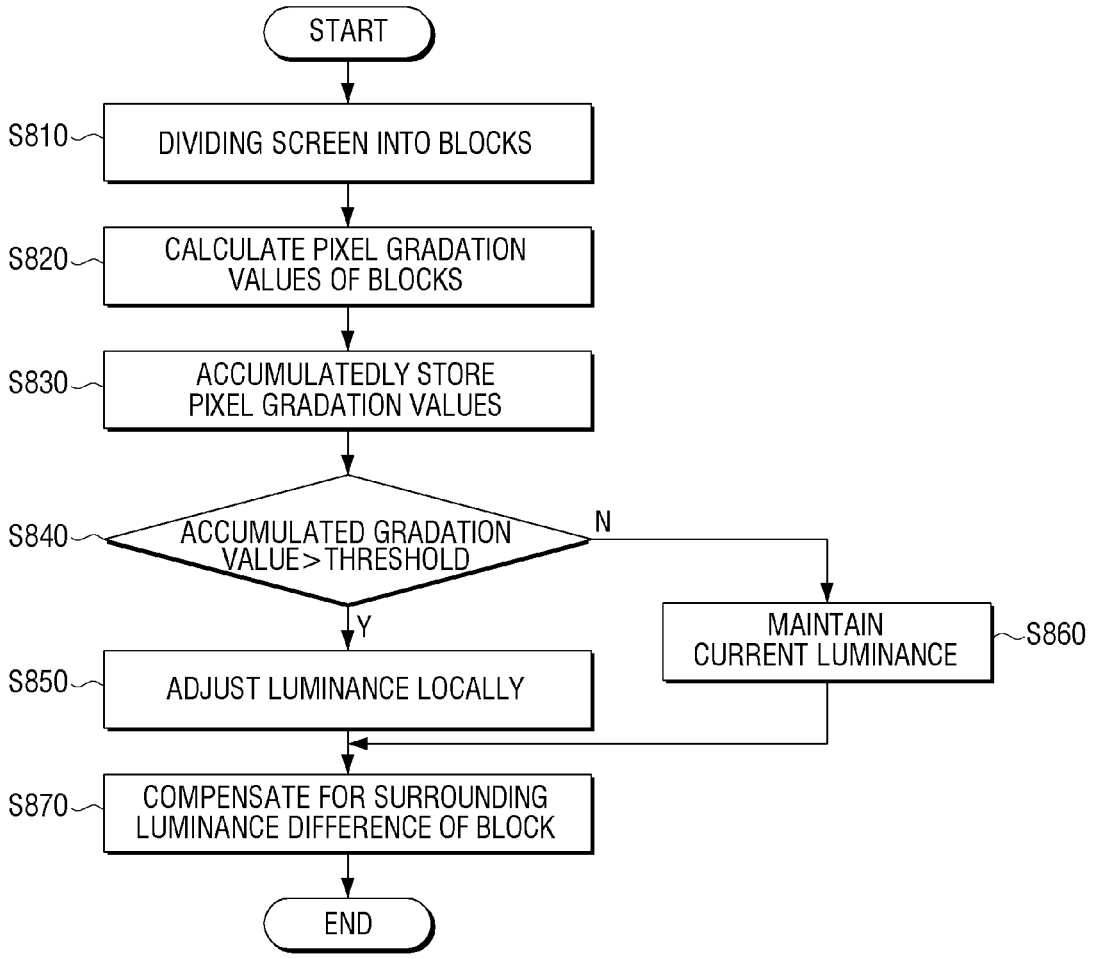
FIG. 8 is a view illustrating a display method according to an exemplary embodiment.

FIG. 8 is a view illustrating a display method according to an exemplary embodiment. According to FIG. 8, a display apparatus divides the image frame displayed on the display panel into a plurality of pixel blocks (operation S810). The method of dividing the plurality of pixel blocks was explained hereinabove, and is thus omitted.

Next, a pixel gradation value of each of the plurality of pixel blocks is calculated (operation S820), and the calculated pixel gradation value is accumulatively stored (operation S830). In this case, it is possible to store the entirety of the accumulated pixel gradation values, and store the average of the gradation value per pixel block. In addition, it is possible to store the number of the high gradation value per pixel block and to set a threshold of determining a high gradation and store the same.

At this stage, the display apparatus determines whether the accumulated gradation value of the pixel block forming each image frame exceeds the threshold (operation S840). For the pixel block having an accumulative gradation value exceeding the threshold, the luminance is locally reduced (operation S850). On the other hand, regarding the pixel block having an accumulative gradation value that does not exceed the threshold, the luminance is maintained (operation S860). Next, the luminance difference between the blocks surrounding the pixel block is compensated for (operation S870).

The luminance compensation method and luminance difference compensation method were explained with reference to FIG. 5 to FIG. 7 above, and thus repeated explanation is omitted.

The above-described methods of exemplary embodiments may be applied to the spontaneous emission display apparatuses, and also to other various apparatuses in which above-described methods may be used.

The display method of the display apparatus according to exemplary embodiments may be embodied as a program and be provided to the display apparatus.

More specifically, in the display method of the display apparatus, there may be provided a non-transitory computer-readable medium storing a program including dividing a screen of a display panel in a plurality of pixel blocks, calculating a pixel gradation value of each of the plurality of pixel blocks and accumulating the calculated pixel gradation value, storing the accumulated pixel gradation value, locally reducing a luminance regarding a block of which an accumulated pixel gradation value exceeds a threshold of among the plurality of pixel blocks, and compensating for a luminance difference between the block having the reduced luminance and surrounding blocks.

A non-transitory computer-readable medium is a computer-readable medium which stores data semi-permanently and not temporarily such as register, cache, and memory etc. More specifically, the aforementioned various applications or programs may be stored in a non-transitory computer-readable medium such as a CD, DVD, hard disk, blu-ray, USB, memory card, ROM, etc.

The foregoing exemplary embodiments and advantages are merely exemplary and are not to be construed as limiting. The present teaching can be readily applied to other types of apparatuses. The description of the exemplary embodiments is intended to be illustrative, and not to limit the scope of the claims, and many alternatives, modifications, and variations will be apparent to those skilled in the art.

What is claimed is:

1. A display apparatus comprising:

a display panel configured to display an image frame;

an arithmetic operator configured to divide the image frame into pixel blocks, calculate pixel gradation values of the pixel blocks, and accumulate the calculated pixel gradation values, for a number of image frames displayed in succession or a time period; and a compensator configured to locally reduce a luminance of a corresponding pixel block, of which a respective accumulated pixel gradation value exceeds a certain threshold value of the pixel blocks, and to compensate for a luminance difference between the corresponding pixel block, for which the luminance has been reduced, and surrounding pixel blocks which are disposed in a vicinity of the corresponding pixel block, wherein the compensator comprises:

a gain calculator configured to calculate a gain value;

a first compensation gain calculator configured to calculate a first compensation gain value for compensating for the luminance difference between the pixel blocks, by applying an edge smoothing filter to the calculated gain value;

a second compensation gain calculator configured to calculate a second compensation gain value for removing a flicker due to a temporal luminance change of the pixel blocks by applying an Infinite Impulse Response (IIR) filter to the first compensation gain value; and a pixel adjuster configured to calculate a pixel gain value for each pixel of the pixel blocks based on the second compensation gain value, reflect the calculated pixel gain value to the gradation value of each pixel, and provide the gradation value of the pixel to the display panel.

2. The apparatus according to claim 1, wherein the edge smoothing filter is a diffusion filter or a bilateral filter.

3. The apparatus according to claim 1, wherein the second compensation gain calculator uses a calculation function to calculate the second compensation gain value according to an equation:

$$Giir = \frac{(Wa * Ga + Wc * Gc)}{Wa + Wc},$$

wherein Giir is the second compensation gain value,

Ga is the gain value of a previous frame,

Gc is the gain value of a present frame,

Wa is a weighted value for the gain value of the previous frame, and

Wc is a weighted value for the gain value of the present frame.

4. The apparatus according to claim 1, wherein the gain calculator classifies one block of the pixel blocks of which the accumulated pixel gradation value is less than a first threshold value as belonging to a first area, classifies another block of the pixel blocks of which the accumulated pixel gradation value is equal to the first threshold value or more and less than a second threshold value as belonging to a second area, classifies other block of the pixel blocks of which the accumulated pixel gradation value is equal to the second threshold value or more as belonging to a third area, sets a first gain value for the first area, a third gain value for the third area to be smaller than the first gain value, and calculates a second gain value for the second area according to a linear function or a non-linear function to be a value between the first gain value and the third gain value, and the second threshold value corresponds to the certain threshold value.

5. The apparatus according to claim 4, wherein the linear function is $$Y = \left(\frac{b - a}{THb - THa}\right) * (X - THa) + a$$

wherein X is the accumulated pixel gradation value,

Y is the second gain value for the second area,

THa is the first threshold value,

THb is the second threshold value, a is the first gain value, and b is the third gain value.

6. The apparatus according to claim 1, wherein the pixel adjuster applies a weighted value to the second compensation gain value according to a distance between surrounding blocks for each pixel of the pixel blocks, calculates a gain value per pixel, reflects the calculated gain value per pixel to the gradation value of each pixel, and provides corrected pixel gradation values of the pixels to the display panel.

7. A display method comprising:

dividing an image frame displayed on a display panel into pixel blocks;

calculating pixel gradation values of the pixel blocks;

accumulating the calculated pixel gradation values of the pixel blocks for a number of image frames displayed in succession or a time period;

locally reducing a luminance for a corresponding pixel block of which the accumulated pixel gradation value exceeds a certain threshold value; and compensating for a luminance difference between the corresponding pixel block, for which the luminance has been reduced, and surrounding pixel blocks which are disposed in a vicinity of the corresponding pixel block, wherein the compensating comprises:

calculating a gain value;

calculating a first compensation gain value for compensating for a luminance discontinuity between the pixel blocks, by applying an edge smoothing filter to the calculated gain value;

calculating a second compensation gain value for removing a flicker due to a temporal luminance change of the pixel blocks, by applying an Infinite Impulse Response (IIR) filter to the calculated first compensation gain value;

calculating a pixel gain value for each pixel of the pixel blocks, based on the second compensation gain value;

reflecting the calculated pixel gain value to the gradation value of each pixel; and providing the pixel gradation value, to which the pixel gain value has been reflected, to the display panel.

8. The method according to claim 7, wherein the edge smoothing filter is a diffusion filter or bilateral filter.

9. The method according to claim 7, wherein the calculating the second compensation gain value uses calculation function to calculate the second compensation gain value according to an equation:

$$Giir = \frac{(Wa * Ga + Wc * Gc)}{Wa + Wc}$$

wherein Giir is the second compensation gain value,

Ga is the gain value of a previous frame,

Gc is the gain value of a present frame,

Wa is a weighted value for the gain value of the previous frame, and

Wc is a weighted value for the gain value of the present frame.

10. The method according to claim 7, wherein the calculating the gain value comprises:

classifying the pixel block of which the accumulated pixel gradation value is less than a first threshold value to belong to a first area;

classifying the pixel block of which the accumulated pixel gradation value is equal to the first threshold value or more and less than a second threshold value to belong to a second area;

classifying the pixel block of which the accumulated pixel gradation value is equal to the second threshold value or more to belong to a third area;

setting a first gain value for the first area;

setting a third gain value for the third area to be smaller than the first gain value; and calculating a second gain value for the second area according to a linear function or a non-linear function as a value between the first gain value and the third gain value, wherein the second threshold value corresponds to the certain threshold value.

11. The method according to claim 10, wherein the linear function is $$Y = \left(\frac{b - a}{THb - THa}\right) * (X - THa) + a$$

wherein X is the accumulated pixel gradation value,

Y is the second gain value for the second area,

THa is the first threshold value,

THb is the second threshold value, a is the first gain value, and b is the third gain value.

12. The method according to claim 7, wherein the pixel adjusting comprises:

applying a weighted value to the second compensation gain value according to a distance between surrounding blocks for each pixel of the pixel blocks;

calculating a gain value per pixel;

reflecting the calculated gain value per pixel to each pixel, and providing corrected pixel gradation values for the pixels of the display panel according to the reflected gain value per pixel.

13. A display apparatus comprising:

a display panel configured to display an image frame;

an arithmetic operator configured to divide the image frame into pixel blocks, calculate pixel gradation values of the pixel blocks, and accumulate the calculated pixel gradation values, for a number of image frames displayed in succession or a time period; and a compensator configured to locally reduce a luminance of a corresponding pixel block, of which a respective accumulated pixel gradation value exceeds a second threshold value of the pixel blocks, and to compensate for a luminance difference between the corresponding pixel block, for which the luminance has been reduced, and surrounding pixel blocks which are disposed in a vicinity of the corresponding pixel block, wherein the corresponding pixel block, for which the luminance has been reduced, is a first block, and the compensator is configured to compensate for the luminance difference by:

categorizing the surrounding pixel blocks into a second block having the accumulated pixel gradation value less than a first threshold value and a third block having the accumulated pixel gradation value equal to or greater than the first threshold value and less than the second threshold value, setting a second gain value for the second block, setting a first gain value for the first block to be smaller than the second gain value, and setting a third gain value for the third block to be equal to a value between the first gain value and the second gain value.

* * * * *